US005315979A

United States Patent [19]

Kako

[11] Patent Number: 5,315,979

[45] Date of Patent: May 31, 1994

[54] ELECTRONIC CONTROL APPARATUS FOR AN INTERNAL COMBUSTION ENGINE

[75] Inventor: Hajime Kako, Himeji, Japan

[73] Assignee: Mitsubishi Denki Kabushiki Kaisha, Tokyo, Japan

[21] Appl. No.: 21,847

[22] Filed: Feb. 24, 1993

[30] Foreign Application Priority Data

Mar. 27, 1992 [JP] Japan ..... 4-71175

[51] Int. Cl.[5] ..... F02D 41/02

[52] U.S. Cl. ..... 123/478

[58] Field of Search ..... 123/478, 480, 486, 487, 123/494

[56] References Cited

U.S. PATENT DOCUMENTS 4,582,031 4/1986 Janetzke et al. ..... 123/339

4,913,121 4/1990 Shimomura et al. ..... 123/681

FOREIGN PATENT DOCUMENTS 159447 6/1989 Japan .

*Primary Examiner*—Tony M. Argenbright

*Attorney, Agent, or Firm*—Sughrue, Mion, Zinn, Macpeak & Seas

[57] ABSTRACT

An electronic control apparatus for an internal combustion engine includes a microprocessor for calculating an atmospheric pressure value by using an arithmetic formula in which the ratio of a charging efficiency obtained by an intake air flow rate to a memorized set value is used, wherein the microprocessor calculates the atmospheric pressure value when a steady operation detecting means detects the operational condition of the engine to be a steady operation for a first predetermined period of time, and uses the calculated atmospheric pressure value in order to control the engine only when the steady operation detecting means detects the engine to be the steady operation for a second predetermined period of time.

1 Claim, 5 Drawing Sheets

ELECTRONIC CONTROL APPARATUS FOR AN INTERNAL COMBUSTION ENGINE

BACKGROUND OF THE INVENTION

1. Field of the Invention

The present invention relates to an electronic control apparatus for an internal combustion engine wherein an atmospheric pressure related value such as an atmospheric pressure is obtained through an arithmetic operation by using another control parameter for the internal combustion engine, and the thus obtained value is used as an auxiliary parameter for controlling.

2. Discussion of Background

As an electronic control apparatus for an internal combustion engine of this kind, there has been known publication such as Japanese Unexamined Patent Publication No. 159447/1989. The detail of the electronic control apparatus disclosed in the publication will be described with reference to FIG. 1 which is also used for the explanation of an embodiment of the present invention.

In FIG. 1, reference numeral 1 designates an internal combustion engine having a plurality of cylinders 2 mounted on an automobile in which only one cylinder 2 is illustrated, numeral 3 designates an intake valve for the internal combustion engine 1, actuated by a cam (not shown), numeral 4 designates an intake manifold of the internal combustion engine 1, numeral 5 designates an injector disposed for each of the cylinders, disposed in the intake manifold 4, and numeral 6 designates a surge tank connected at the upstream side of the intake manifold 4.

Numeral 7 designates a throttle valve disposed in an intake passage at the upstream side of the surge tank 6 to control the flow rate of air sucked into the internal combustion engine 1, numeral 8 designates a throttle sensor for detecting degrees of opening of the throttle valve 7, numeral 9 designates a by-pass passage connected between the upstream side and the downstream side of the throttle valve 7, numeral 10 designates a by-pass air quantity regulator, numeral 11 designates a hot wire type air flow sensor (AFS) as an air flow rate sensor which is disposed at the upstream side of the throttle valve 7 to detect the flow rate of air sucked into the internal combustion engine 1 by using a temperature dependence resistor, numeral 12 designates an air temperature sensor for detecting the temperature of air before it has been passed through the AFS 11, and numeral 13 designates an air cleaner disposed at an inlet port at the upstream side of the AFS 11 and the air temperature sensor 12.

Numeral 14 designates a water temperature sensor disposed in a cooling passage for the internal combustion engine 1 to detect the temperature of cooling water, numeral 15 designates an $O_2$ sensor as an air-fuel ratio sensor attached to an exhaust pipe to detect the air-fuel ratio, numeral 16 designates a crank angle sensor for detecting a crank angle of the internal combustion engine, and numeral 17 designates an electronic control unit (ECU) which determines a fuel injection quantity on the basis of output signals supplied mainly from the AFS 11, the water temperature sensor 14 and the crank angle sensor 16, and controls the injector 5 for fuel injection in synchronism with the output signal of the crank angle sensor 16.

Also the output signals of the throttle sensor 8, the air temperature sensor 12 and the $O_2$ sensor 15 are used as auxiliary parameters for the ECU 17. The ECU 17 performs also control for the by-pass air quantity regulator 10 so as to adjust the revolution number of the internal combustion engine 1, however, the detail of the operation is omitted.

FIG. 2 shows the internal structure of the ECU 17 shown in FIG. 1. In FIG. 2, reference numeral 171 designates a digital interface for receiving digital signals from the crank angle sensor 16, wherein the output of the digital interface is inputted to a port or an interruption terminal of the CPU 172. The CPU 172 is a well known microprocessor including an ROM 1721 in which the control programs of flows shown in FIGS. 4 and 5 and data related thereto are written, an RAM 1722 as a work memory and a timer 1723. The CPU 172 generates a value such as a fuel injection pulse width calculated in accordance with a predetermined control program through an output of the timer.

Reference numeral 173 designates an analog interface for receiving analog signals from steady operation detecting means such as the throttle sensor 8, the AFS 11, the air temperature sensor 12, the water temperature sensor 14 and the $O_2$ sensor 15. The outputs of the analog interface 173 are sequentially selected by a multiplexer 174 and is subjected to analog-digital conversion by an A/D converter 175 so that digital values are supplied to the CPU 172.

Numeral 176 designates a first driving circuit which drives the injector 5 with a fuel injection pulse width operated by the CPU 172. Numeral 177 designates a second driving circuit which drives the by-pass air quantity regulator 10 with an ISC driving pulse width which is calculated in accordance with a predetermined control program and generated through an output terminal of the timer.

The CPU 172 stores as a two-dimensional map the charging efficiency $\eta_{co}$ under a reference atmospheric condition of an atmospheric pressure of $P_o$ and an air temperature $T_o$ wherein the revolution number and the throttle opening degree are used as parameters. Further, the CPU 172 previously stores set data for judging and calculating. In addition, the CPU 172 stores in a form of map the maximum air flow rate value $Q_{maxo}$ under the reference atmospheric condition in the ROM 1721 wherein the revolution number is used as a parameter, for instance.

The operation of the CPU 172 will be described. First of all, an atmospheric correction value is obtained by using the following formula 1 wherein $P_a$ is an atmospheric pressure value used for controlling the operation characteristic quantity of the internal combustion engine, the value being outputted from the AFS for instance, $P_o$ is a set atmospheric value under a reference atmospheric condition, $T_a$ is an air temperature value detected by and outputted form the air temperature sensor 12, $T_o$ is a reference air temperature set value under a reference air condition, $\eta_c$ is a charging efficiency and $\eta_{co}$ is a charging efficiency under the reference atmospheric condition:

$$\frac{P_a}{P_o} \approx \sqrt{\frac{T_a}{T_o}} \cdot \frac{\eta_c}{\eta_{co}}$$

Explanation of the theoretical ground of the formula 1 is omitted.

The operation of obtaining the atmospheric pressure correction value with use of the formula 1 will be described with reference to FIG. 4.

At Step S0, a charging efficiency $\eta_c$ at present is obtained by the calculation of the following formula 2 by using a revolution number signal N detected by the crank angle sensor 16, an air flow rate value $Q_a$ from the AFS 11 (or an air flow rate value $Q_a$ detected by the AFS 11 in FIG. 5), a predetermined cylinder capacity $V_H$ and an air density $\rho_o$ (the cylinder capacity and the air density are previously memorized) under a reference atmospheric condition:

$$\eta_c = \frac{Q_a}{\frac{N}{30} \cdot V_H \cdot \rho_0}$$

At Step S1 and Step S2, determination is made as to whether or not the operational condition at present is a steady operation. Namely, Step S1 is a step for judging whether or not the absolute value $|\Delta\theta|$ of a deviation of the throttle opening degree in every predetermined time which is obtained by a routine (not shown) is a predetermined value $\theta_T$ or higher. When it is found that the absolute value assumes the predetermined value or higher, a steady operation continuing counter is reset to 0 at Step S3 under the recognition that it is a transient operation. When the absolute value is lower than the predetermined value $\theta_T$, determination is made as to whether or not the absolute value $|\Delta N|$ of a deviation of the revolution number in every predetermined time which is obtained by a routine (not shown) is a predetermined value $N_T$ or higher at Step S2.

When it is revealed to be the predetermined value or higher, the transient operation is conducted, and the steady operation continuing counter is reset to 0 at Step 3. When the value is lower than the predetermined value $N_T$, a steady operation is continued, and the steady operation continuing counter is increased by "1" at Step S4. After the completion of Step S3 or Step S4, determination is made as to whether or not the steady operation continuing counter counts a predetermined time m or more at Step S5. When the counter shows the predetermined time m or more, the steady operation is considered to continue for the predetermined time m or more, and sequential operation is moved to Step S6. When the counter counts less than the predetermined time m, the treatment shown in FIG. 4 is finished.

At Step S6, a charging efficiency $\eta_{co}$ under the reference atmospheric condition is obtained by looking up a two-dimensional map including throttle opening degree and revolution number N which is prepared with signals of throttle opening degree detected by the throttle sensor 8 and signals of the revolution number N detected by the crank angle sensor 16.

Then, at Step S7, an atmospheric pressure correction value $C_p$ ($=P_a/P_o$) is obtained through calculation in accordance with the formula 1 wherein the air temperature set value $T_o$, the charging efficiencies $\eta_{co}$ and $\eta_c$ obtained in accordance with the above-mentioned operations and an air temperature value $T_a$ detected by the air temperature sensor 12 are used.

At Step S8, filtering treatment of the atmospheric pressure correction value $C_p$ is conducted. The filtering treatment is conducted by operating the following formula:

$$C_p(i) = K \cdot C_p(i-1) + (1-k) \cdot C_p$$

wherein k is a value of from 0 to 1 and $C_p(i-1)$ is an atmospheric pressure correction value obtained by the previous treatment. The atmospheric pressure correction value $C_p$ or an atmospheric pressure correction value $C_p(i)$ at present which is obtained after the filtering treatment are stored even after the key switch has been turned off, and they are immediately used for atmospheric pressure correction when the key switch is again turned on.

FIG. 5 is a flow chart of a routine to obtain an air flow rate value $Q_a$ by using the atmospheric pressure correction value.

At Step S21, the maximum air flow rate value $Q_{maxo}$ corresponding to each revolution number under the reference atmospheric condition is obtained. A symbol $f_{(N)}$ expresses a table of the maximum air flow rate value $Q_{maxo}$ using the revolution number as a factor. The maximum air flow rate value $Q_{maxo}$ is obtainable from the revolution number N obtained on the basis of the output signals of the crank angle sensor 16.

Step S22 is a step to determine a reverse flow region in the internal combustion engine 1 by using the revolution number N. Namely, when the revolution number N is in a range from N1 to N2 (i.e. $N1<N<N2$) i.e. in the reverse flow region and the sequential operation is moved to S23. Otherwise, sequential operation is moved to Step S24.

At Step S23, the maximum air flow rate $Q_{maxo}$ under the reference atmospheric condition is subjected to atmospheric pressure correction and temperature correction, and the maximum air flow rate value $Q_{max}$ at the current atmospheric condition is obtained by calculating the following formula 3:

$$Q_{max} = Q_{maxo} \cdot C_p(i) \cdot \frac{T_o}{T_a}$$

where $T_o$ is an air temperature set value under the reference atmospheric condition and $T_a$ is an air temperature value at present detected by the air temperature sensor 12.

The term of temperature correction at the third term of the right side of the formula can be omitted for simplification of the system or it can be replaced by water temperature correction by the water temperature sensor.

At Step S24, the maximum air flow rate value $Q_{maxo}$ under the reference atmospheric condition is substituted for $Q_{max}$. This step is conducted on the assumption of using the AFS capable of correctly measuring the air flow rate except for the reverse flow region. If such AFS is not used, the treatments of Step S22 and Step S24 are not conducted. It is also possible to omit the Step S22 and the Step S24 even when the AFS capable of correctly measuring the air flow rate.

Step S23 or Step S24 and Step S25 are steps for comparing an air flow rate value $Q_a$ measured by the AFS 11 with the maximum air flow rate value $Q_{max}$. When $Q_a \geqq Q_{max}$, the air flow rate value $Q_a$ is limited by $Q_{max}$. When $Q_a < Q_{max}$, no treatment is conducted and the series of treatments shown in FIG. 5 is finished.

In the conventional electronic control apparatus for an internal combustion engine having the construction as describe above, generally, there is a difference between response to a change of throttle opening degree in the throttle sensor and response to a change of air flow rate in the AFS. Further, there is a difference in delay time in processing analog signals in the analog interface and a timing of conversion in the A/D converter. Accordingly, there is a case of lacking simultaneity between the air flow rate value $Q_a$ for obtaining the charging efficiency $\eta_c$ at present in the formula 1 and the throttle opening degree $\theta$ or the revolution number N for obtaining the charging efficiency $\eta_{co}$ under the reference atmospheric condition, just after having moved from the steady operation to a transient operation. Nevertheless, the atmospheric pressure correction value $C_p$ may be obtained on the basis of the formula 1 on the judgment that the steady operation continues yet. In such case, the atmospheric pressure correction value $C_p$ is deviated from a correct value. As a result, correction of, for instance, the maximum air flow rate value becomes incorrect, whereby the air fuel ratio at the full open operation of the engine becomes excessively thick or thin.

SUMMARY OF THE INVENTION

It is an object of the present invention to provide an electronic control apparatus for an internal combustion engine free from using an erroneous atmospheric correction value which may result from the calculation in a time from the steady operation to a transient operation, for controlling the internal combustion engine.

In accordance with the present invention, there is provided an electronic control apparatus for an internal combustion engine which comprises:

a memory means which previously memorizes and sets as a two-dimensional map charging efficiency values or related values of charging efficiency corresponding to degrees of opening of a throttle valve under a reference atmospheric condition and revolution numbers of an internal combustion engine, and which outputs a memorized set value memorized and set in correspondence to a throttle opening degree signal outputted from a throttle sensor for detecting a degree of opening of the throttle valve and a revolution number signal outputted from a revolution number detecting sensor;

a steady operation detecting means for detecting that the operational condition of the internal combustion engine is steady, when at least a quantity of change of the throttle opening signal within a predetermined time is lower than a predetermined value; and an arithmetic means which calculates an atmospheric pressure related value including at least an atmospheric pressure value in accordance with a given arithmetic expression which uses the ratio of a value of charging efficiency or a related value of charging efficiency obtained by selectively using an intake air flow rate signal outputted from an air flow rate sensor for detecting an intake air flow rate in the internal combustion engine and said revolution number signal, to the memorized set value outputted from the memory means, and which calculates said atmospheric pressure related value when said steady operation detecting means detects the operational condition of the engine to be a steady operation for a first predetermined period of time, and uses the calculated atmospheric pressure related value in order to control the engine only when said steady operation detecting means detects the engine to be the steady operation for a second predetermined period of time.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

A preferred embodiment of the present invention will be described with reference to the drawings.

Figure 1:
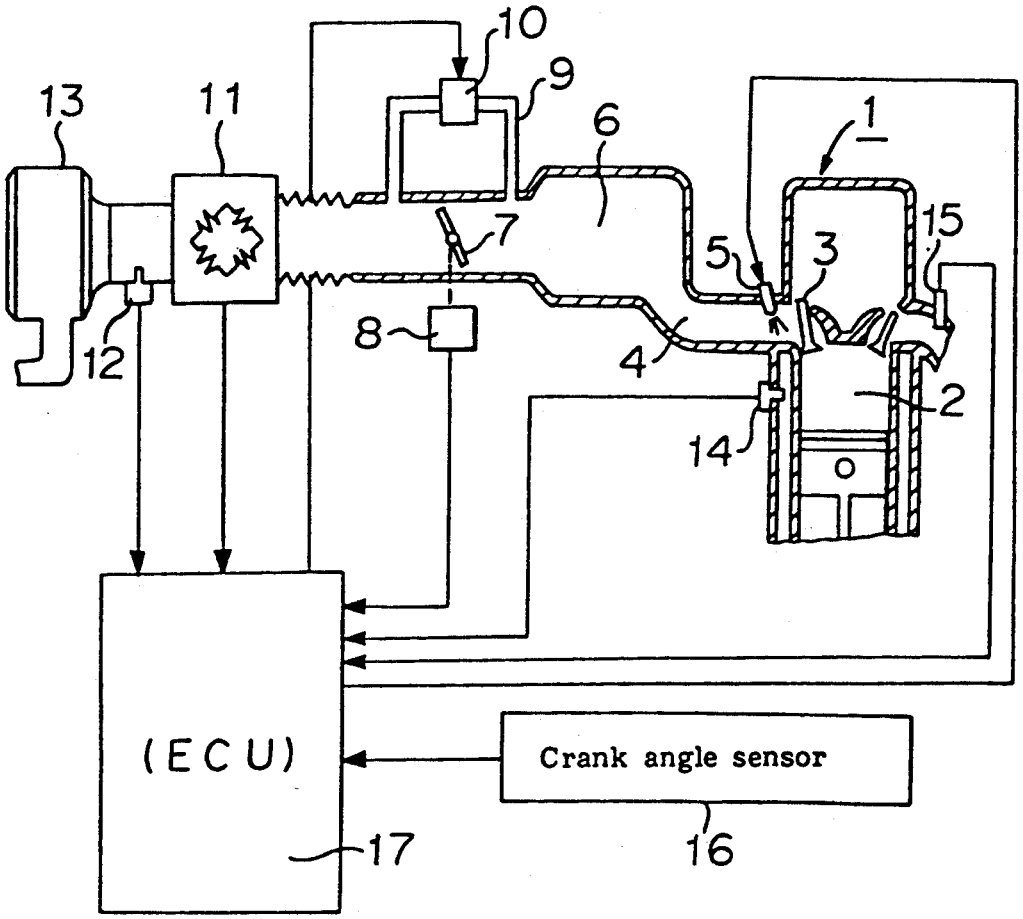
FIG. 1 is a schematic view showing the entire structure of an embodiment of the electronic control apparatus for an internal combustion engine according to the present invention.

FIG. 1 is a schematic view showing the electronic control apparatus for an internal combustion engine according to an embodiment of the present invention, particularly, it shows the entire construction of a hot wire type fuel injection control apparatus. Since the detail of the construction of the control apparatus was already mentioned, overlapping description is omitted.

Figure 2:
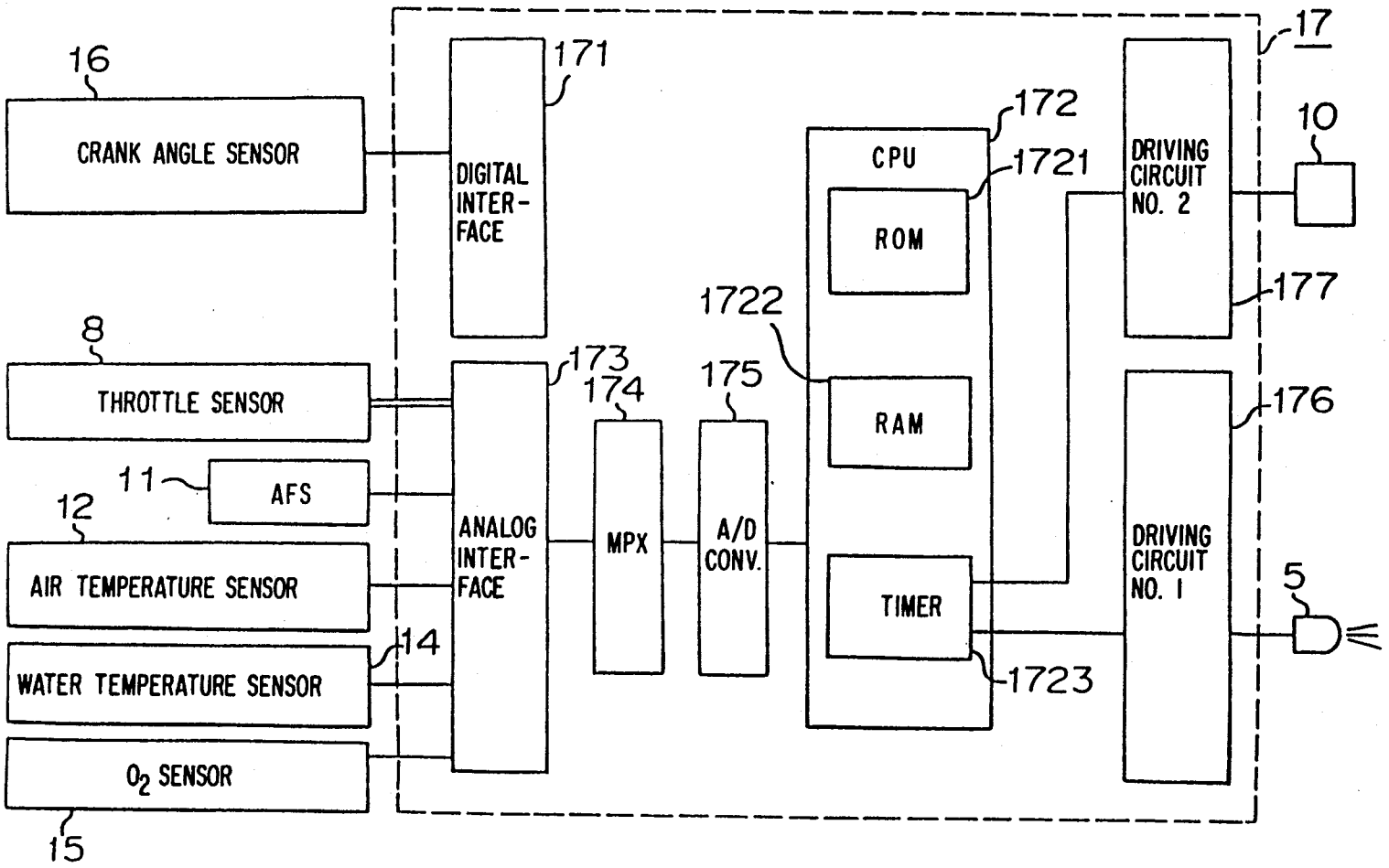
FIG. 2 is a block diagram showing the internal construction of an ECU used for the embodiment shown in FIG. 1.
Figure 5:
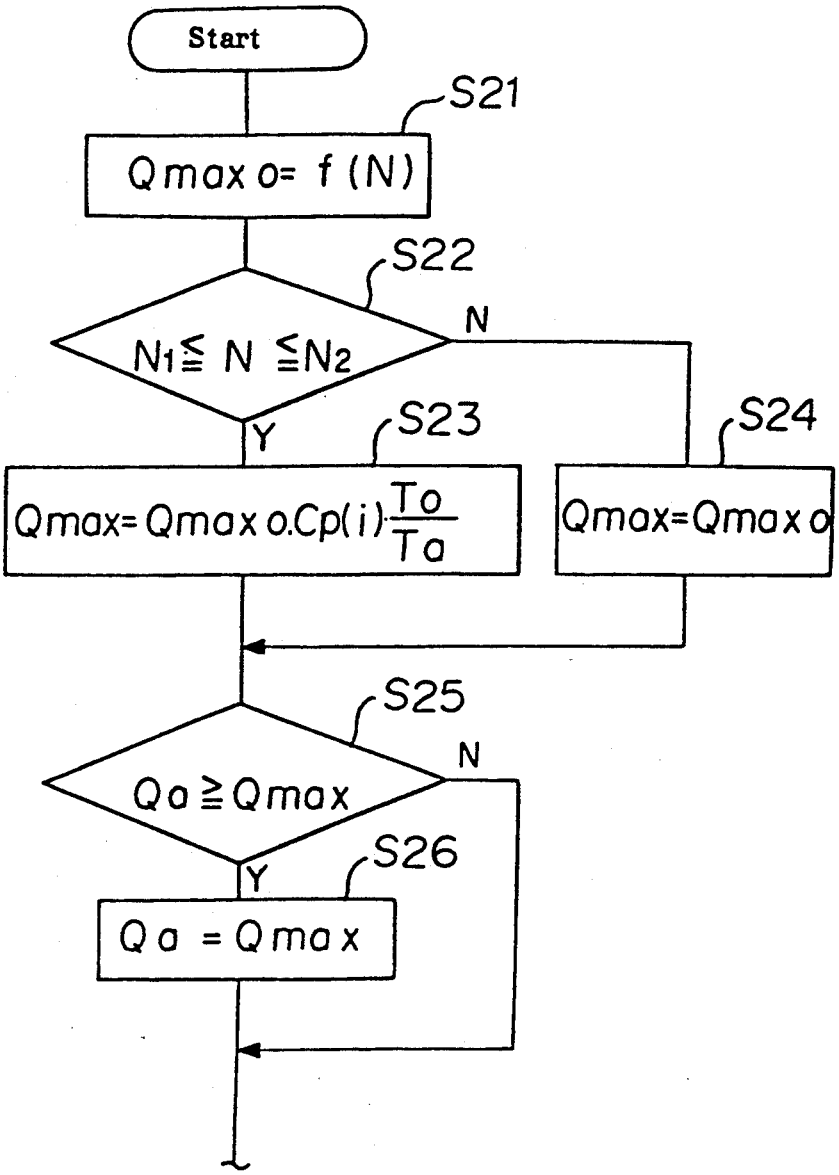
FIG. 5 is a flow chart of a routine for obtaining an air flow rate value by using an atmospheric pressure correction value in the conventional electronic control apparatus.

FIG. 2 shows the internal construction of the ECU 17 shown in FIG. 1. The internal construction is the same as that mentioned before except that ROM 1721 stores control programs of the flows shown in FIGS. 3 and 5 and data related thereto. Accordingly, description of the internal construction is omitted.

Figure 3:
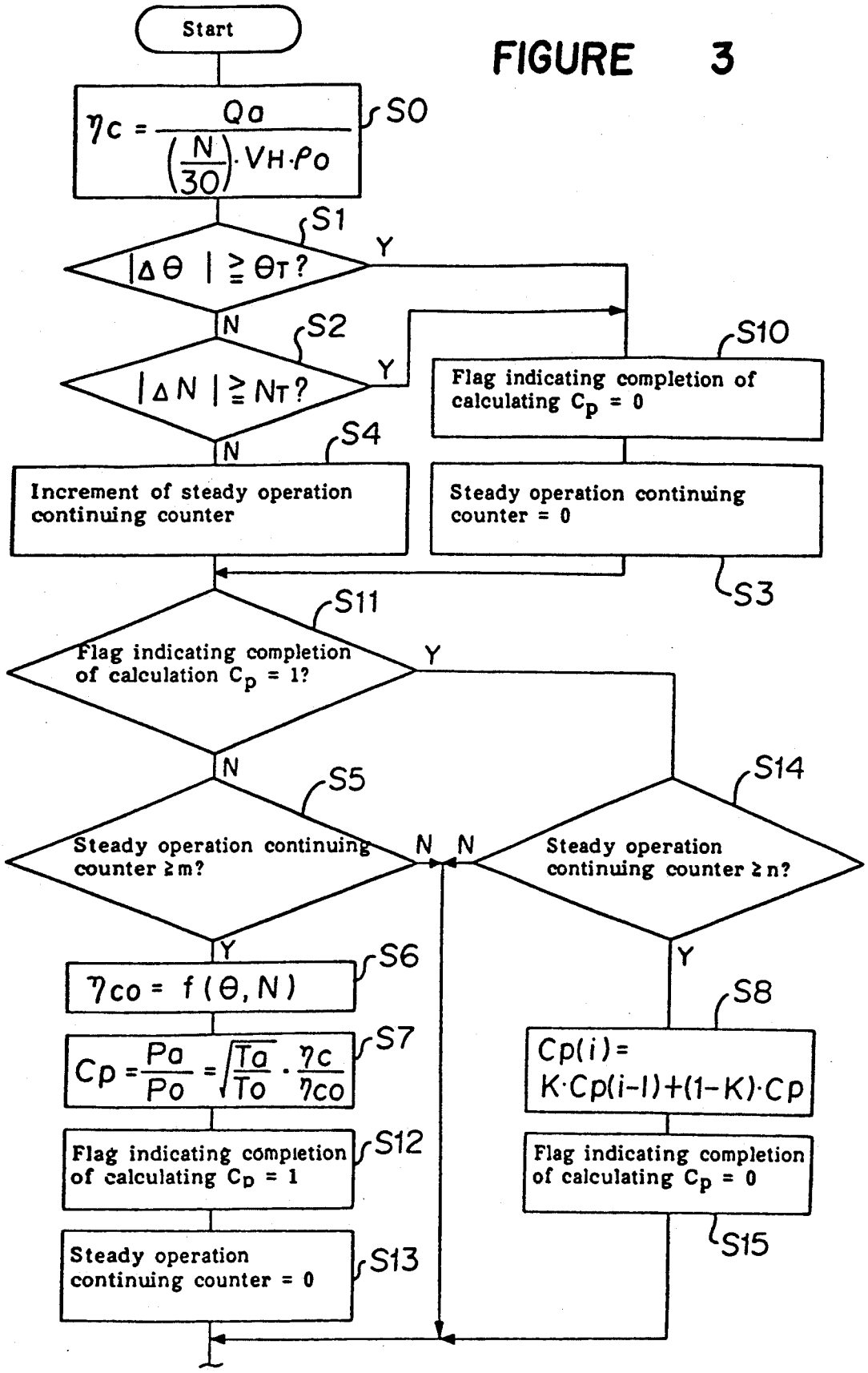
FIG. 3 is a flow chart showing a flow of processing of controlling the electronic control apparatus of the present invention.
Figure 4:
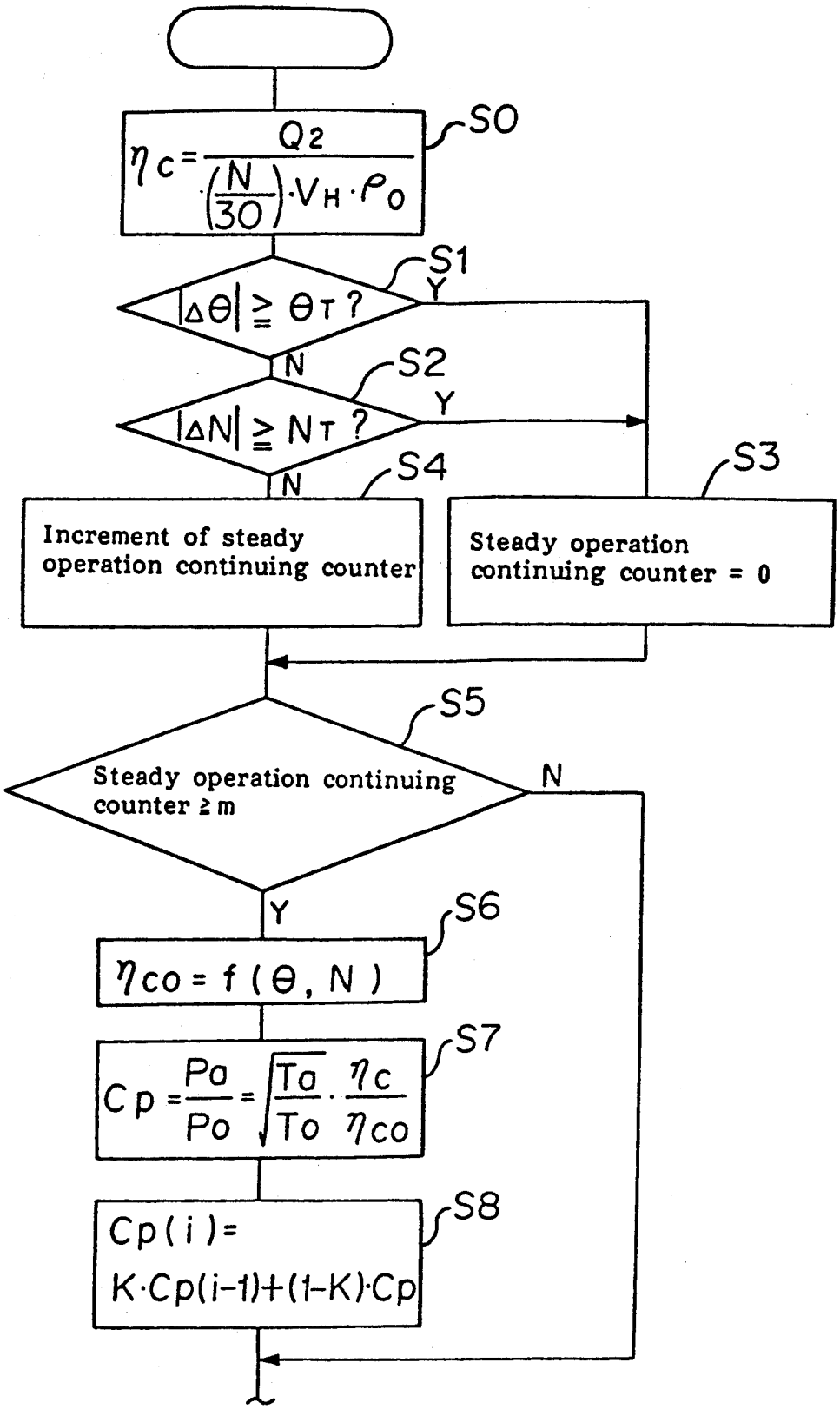
FIG. 4 is a flow chart showing a flow of the processing of a conventional electronic control apparatus for an internal combustion engine.

The operation of the electronic control apparatus for an internal combustion engine according to the present invention will be described with reference to FIG. 4. The processing program of FIG. 3 is the same as that of FIG. 4 except that the treatments of Step S10–Step S15 are added. Accordingly, the same reference numerals are attached to the same treatment portions in FIG. 4, and the description of these portions is omitted.

In FIG. 3, arithmetic operation is conducted to obtain the charging efficiency $\eta_c$ at present on the basis of the formula 2 at Step S0. Then, determination is made as to whether the operational condition at present is the steady operation or a transient operation at Steps S1 and S2. In a case of the transient operation, a flag indicating the completion of calculating the atmospheric pressure correction value $C_p$ is cleared to 0 at Step S10 under the determination that the atmospheric pressure correction value $C_p$ obtained at Step S7 (described thereafter) is null. Then, a steady operation continuing counter is reset to 0 at Step S3.

In a case of determination to be the steady operation, the steady operation continuing counter is increased by "1" at Step S4. After Step S3 or Step S4 has been finished, judgment is made as to whether the flag indicating the completion of calculation the atmospheric pressure correction value $C_p$ is "1" or "0" at Step S11. In a case of "0", determination is made whether or not the steady operation continuing counter shows a predetermined time m or more at Step S5. when the counter shows the predetermined time m or more, the sequential proceeding is moved to Step S6. On the other hand, when the counter shows less than the predetermined time m, the series of treatments in FIG. 3 are finished.

At Step S6, the charging efficiency $\eta_{co}$ under the reference atmospheric condition is obtained. At Step S7, the atmospheric pressure correction value $C_p$ is obtained on the basis of the formula 1. Then, the flag indicating the completion of calculating the atmospheric pressure correction value $C_p$ is set to "1" at Step S12 in order to indicate that the atmospheric pressure correction value $C_p$ has been calculated.

At Step S13, the steady operation continuing counter is reset to 0, and the series of treatments of FIG. 3 is finished.

When the flat indicating the completion of calculation the atmospheric pressure correction value $C_p$ is 1 at Step S11, the sequential procedure is moved to Step S14 where determination is made whether or not the steady operation continuing counter shows a predetermined time n or more. When it is affirmative, i.e. the predetermined time n or more has passed, the sequential procedure is moved to Step S8 after the atmospheric pressure correction value $C_p$ has been calculated at Step S7. If negative, i.e. less than the predetermined time n, the series of treatments of FIG. 3 is finished.

At Step S8, a filtering treatment is conducted to the atmospheric pressure correction value $C_p$ so that an atmospheric pressure correction value $C_p(i)$ after the filtering treatment is obtained. Then, at Step S15, the flag indicating the completion of calculating the atmospheric pressure correction value $C_p$ is cleared to 0 in order to prepare the calculation of the next atmospheric pressure correction value $C_p$, and then the series of treatments of FIG. 3 is finished.

In this case, the maximum air flow rate value $Q_{MAX}$ under the current atmospheric condition is calculated by using the atmospheric pressure correction value $C_p(i)$ to which the filtering treatment has been conducted. In the above-mentioned embodiment, the atmospheric pressure correction value $C_p(i)$ is obtained by conducting the filtering treatment at Step S8 so that the obtained correction value is used for controlling the engine. However, it is possible to substitute $C_p(i)$ for the atmospheric pressure correction value $C_p$ obtained at Step S7 without conducting the filtering treatment.

Thus, in accordance with the present invention, an atmospheric pressure related value is calculated by means of an arithmetic means, and the calculated atmospheric pressure related value is reflected for controlling the engine only when a steady operation detecting means detects the engine to be under the steady operation for a predetermined period of time. Accordingly, an erroneous atmospheric pressure related value which may be obtained by calculation in a moving state from the steady operation to a transient can not be reflected for controlling the engine, whereby control having high reliability and high accuracy can be obtained.

Obviously, numerous modifications and variations of the present invention are possible in light of the above teachings. It is therefore to be understood that within the scope of the appended claims, the invention may be practiced otherwise than as specifically described herein.

What is claimed is:

1. An electronic control apparatus for an internal combustion engine which comprises:

a memory means which previously memorizes and sets as a two-dimensional map charging efficiency values or related values of charging efficiency corresponding to degrees of opening of a throttle valve under a reference atmospheric condition and revolution numbers of an internal combustion engine, and which outputs a memorized set value memorized and set in correspondence to a throttle opening degree signal outputted from a throttle sensor for detecting a degree of opening of the throttle valve and a revolution number signal outputted from a revolution number detecting sensor;

a steady operation detecting means for detecting that the operational condition of the internal combustion engine is steady, when at least, a quantity of change of the throttle opening signal within a predetermined time is lower than a predetermined value; and an arithmetic means which calculates an atmospheric pressure related value including at least an atmospheric pressure value in accordance with a given arithmetic expression which uses the ratio of a value of charging efficiency or a related value of charging efficiency obtained by selectively using an intake air flow rate signal outputted from an air flow rate sensor for detecting an intake air flow rate in the internal combustion engine and said revolution number signal, to the memorized set value outputted from the memory means, and which calculates said atmospheric pressure related value when said steady operation detecting means detects the operational condition of the engine to be a steady operation for a first predetermined period of time, and uses the calculated atmospheric pressure related value in order to control the engine only when said steady operation detecting means detects the engine to be the steady operation for a second predetermined period of time.

* * * * *